United States Patent [19]

Yuunaga

[11] 4,409,705

[45] Oct. 18, 1983

[54] SLIDER FOR A SLIDE FASTENER

[75] Inventor: Saburo Yuunaga, Lahn Marbach, Fed. Rep. of Germany

[73] Assignee: Yoshida Kogyo K.K., Tokyo, Japan

[21] Appl. No.: 269,613

[22] Filed: Jun. 2, 1981

[30] Foreign Application Priority Data

Jun. 14, 1980 [JP] Japan ..... 55-83430[U]

[51] Int. Cl.[3] ..... A44B 19/00

[52] U.S. Cl. ..... 24/205.16 R

[58] Field of Search ..... 24/205.16 R, 205.15 R, 24/205.14 R

[56] References Cited

U.S. PATENT DOCUMENTS 2,867,881 1/1959 Morin ..... 24/205.15 R
2,937,427 5/1960 Mikulas ..... 24/205.15 R
3,011,251 12/1961 McNamara ..... 24/205.15 R
3,013,319 12/1961 Ryser ..... 24/205.14 R

*Primary Examiner*—Gene Mancene
*Assistant Examiner*—Wenceslao J. Contreras
*Attorney, Agent, or Firm*—Robert E. Burns; Emmanuel J. Lobato; Bruce L. Adams

[57] ABSTRACT

A slider for a slide fastener comprises a pair of wings defining a guide channel, one of the wings having a pair of lateral edge flanges. Each flange has a corner ridge extending along its inner base and engageable with upper leg portions of the respective row of fastener elements so as to restrain the latter from being tilted in the guide channel. Each corner ridge is chamfered at its front end, whereby a leading end of the opposed rows of fastener elements, when a pair of opposed fastener stringers is threaded through the slider, is smoothly introduced into the guide channel without having being obstructed by the front ends of the corner ridges.

5 Claims, 9 Drawing Figures

SLIDER FOR A SLIDE FASTENER

BACKGROUND OF THE INVENTION

1. Field of the Invention

The present invention relates generally to slide fasteners, and more particularly to a slider for a slide fastener.

2. Prior Art

A known slide fastener comprises a pair of fastener stringers including a pair of stringer tapes carrying along their inner longitudinal edges a pair of rows of fastener elements attached by holding threads to the respective tapes, each row of fastener elements being in the form of a coiled plastic filament. Each of such fastener elements has a substantially oval contour and it hence tends to be angularly moved or tilted in a slider when a lateral pull is exerted on the corresponding tape. This often results in an unstable and defective coupling of the opposed rows of fastener elements.

To solve this problem, an improved slider has been proposed in which a pair of lateral edge flanges on an upper wing has a pair of corner ridges each extending along an inner base portion of the respective flange through the length thereof at a longitudinally uniform hight. Each of the corner ridges has a fastener-element pressure surface engageable with upper leg portions of the respective row of fastener elements to restrain the fastener elements from being tilted in a guide channel of the slider, the upper leg portion facing the interior side of the upper wing.

However, this slider creates another problem that a leading end of the opposed rows of fastener elements, when a pair of opposed fastener stringers (or a fastener chain) is threaded through the slider in the manufacture of slide fasteners, can be easily obstructed by the front ends of the corner ridges. Accordingly, with such prior art arrangement a proper and smooth threading of the opposed fastener stringers through the slider is difficult to achieve.

SUMMARY OF THE INVENTION

A slider for a slide fastener comprises a slider body including a pair of wings defining a generally Y-shaped guide channel, one of the wings having a pair of flanges projecting respectively from opposite lateral edges of the wing. Each of the flanges has a corner ledge or ridge extending on and along its inner base portion through the length of the flange and having a fastener-element pressure surface engageable with upper leg portions of one of a pair of rows of fastener elements to restrain the fastener elements from being angularly moved or tilted in the guide channel of the slider. Each corner ridge is chamfered at one end adjacent to the front end of the slider to define a front sloping surface joining the pressure surface. With this front sloping surface, the front end of the corner ridge gradually decreases in height toward its distal end, making the front mouth of the guide channel flared both laterally and vertically. Accordingly, a leading end of the opposed rows of fastener elements, when a pair of opposed fastener stringers is threaded through the slider in the manufacture of slide fasteners, is smoothly introduced into the guide channel along the front slopping surfaces on the front ends of the corner ridges.

It is therefore an object of the present invention to provide a slider for slide fasteners which enables a smooth threading of a pair of opposed fastener stringers through the slider.

Another object of the invention is to provide a slider for slide fasteners which enables a smooth and proper coupling and uncoupling of a pair of fastener element rows.

A fuller understanding of the invention will be had by referring to the following description taken in conjunction with the accompanying drawings.

DETAILED DESCRIPTION OF THE PREFERRED EMBODIMENT

Figure 1:
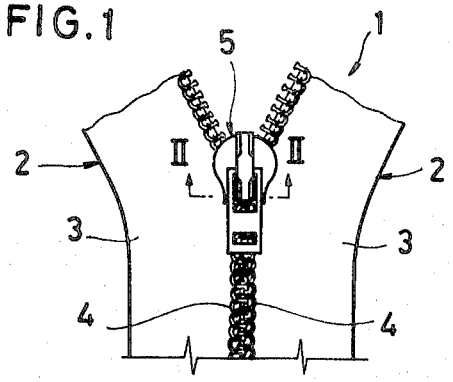
FIG. 1 is a fragmentary plan view of a slide fastener having a slider embodying the invention.
Figure 2:
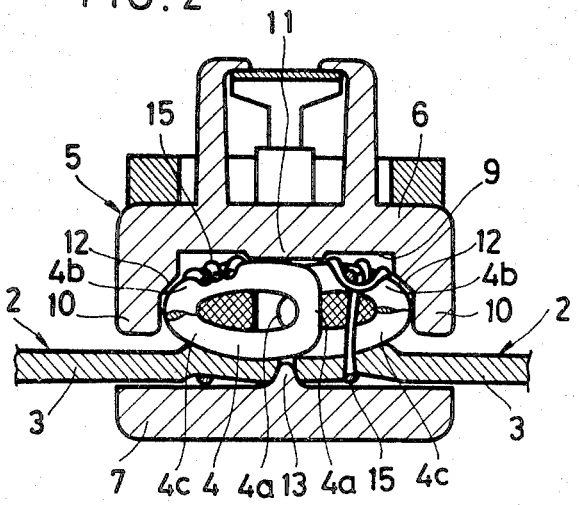
FIG. 2 is an enlarged cross-sectional view taken along section line II—II of FIG. 1.

As shown in FIG. 1, a slide fastener 1 comprises a pair of opposed fastener stringers 2,2 including a pair of tapes 3,3 carrying along their adjacent longitudinal edges a pair of rows of fastener elements 4,4 attached by holding threads 15,15 (FIGS. 2, 6–9) to the respective tapes 3,3. Each row of fastener elements 4 is in the form of a coiled plastic filament. Each fastener element 4 has a coupling head portion 4*a* and a pair of upper and lower leg portions 4*b*,4*c*, defining a generally oval contour, as best shown in FIG. 2. A slider 5 is threaded through the pair of opposed fastener stringers 2,2, for movement along the pair of rows of fastener elements 4,4 for engaging and disengaging the same.

Figure 3:
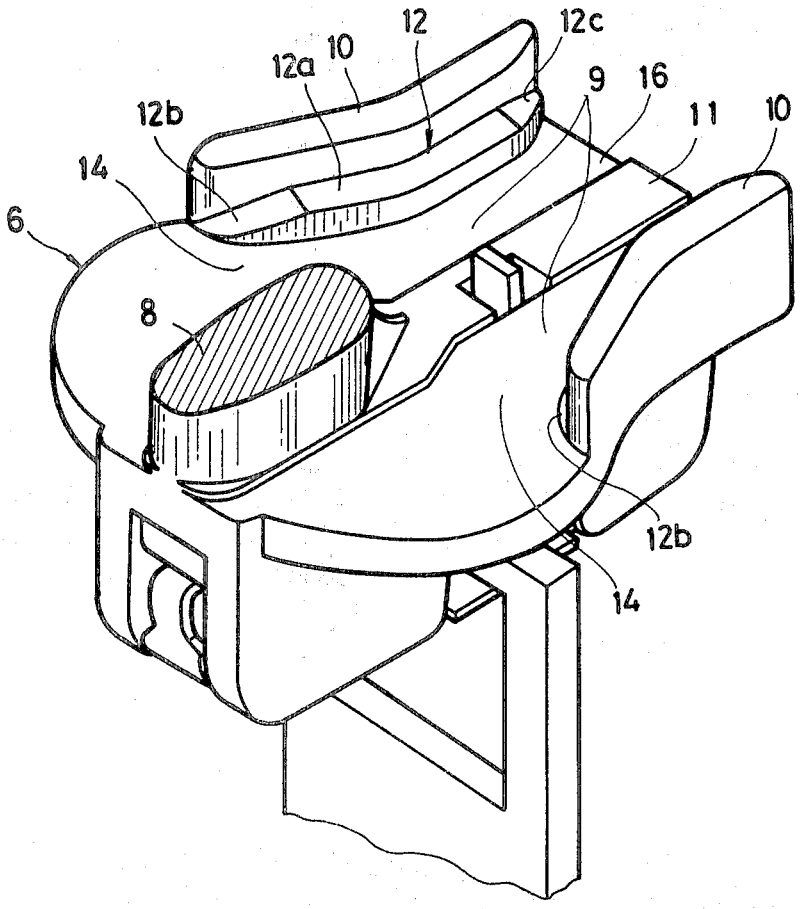
FIG. 3 is an enlarged perspective view, partly in cross section, of an upper wing of the slider, showing the upper wing upside down.

As shown in FIGS. 2 and 3, the slider 5 comprises a slider body including a pair of parallel spaced upper and lower wings 6,7 connected at their front end by a spacer or neck 8 to define a generally Y-shaped guide channel 9 for the passage of the opposed rows of fastener elements 4,4. The upper wing 6 has a pair of flanges 10,10 projecting respectively from opposite lateral edges thereof toward and terminating short of the lower wing 7.

The upper wing 6 has a fastener-element pressure land 11 disposed centrally between the flanges 10,10 and extending longitudinally of the guide channel 9, and engageable with the coupling head portions 4*a* of the fastener elements 4 at their upper side. The upper wing 6 also has a pair of corner ledge or ridges 12,12 each extending on and along an inner base portion of the respective flange 10 through the length thereof and having a fastener-element pressure surface 12*a* engageable with the upper leg portions 4*b* of the fastener elements 4. The pressure surface 12*a* is laterally inclined to fit a part of the oval contour of the fastener element 4 which part is defined by the outer end of the upper leg portion 4b of the fastener element 4, the upper leg portion 4b facing the interior surface of the upper wing 6. The lower wing 7 has a fastener-element pressure ridge 13 disposed opposite to the pressure land 11 on the upper wing 6 and locatable between the adjacent longitudinal edges of the tapes 3,3. The pressure land 11, the corner ridges 12,12 and the pressure ridge 13 jointly serve to restrain the fastener elements 4 from being angularly moved or tilted in the guide channel 9 of the slider 5 with respect to the general plane of the tapes 3,3.

Figure 4:
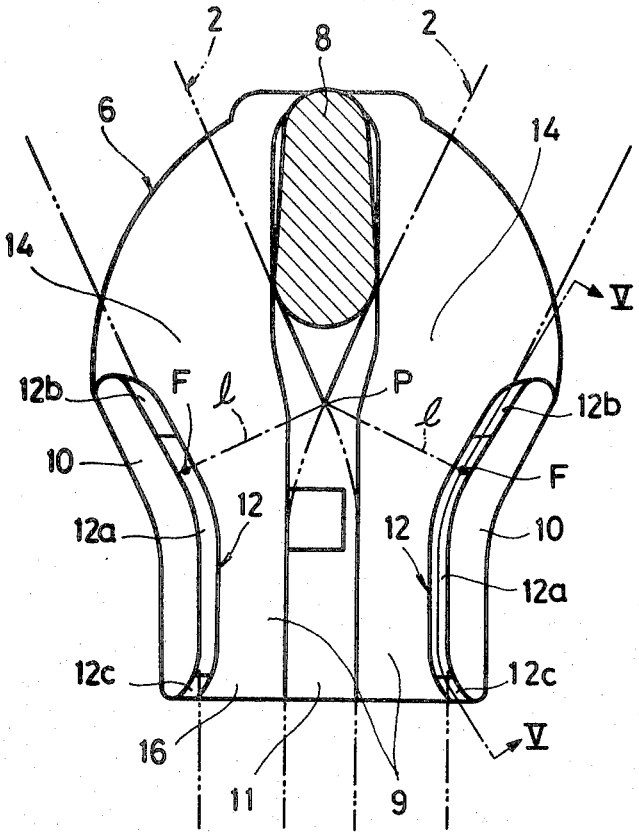
FIG. 4 is an underside view, partly in cross section, of the upper wing.

As best shown in FIG. 3, each of the corner ridges 12 is chamfered at one or front end adjacent to the front end 14 of the slider 5 to define a front sloping surface 12b joining the pressure surface 12a, whereby a leading end of the opposed rows of fastener elements 4,4, when the opposed fastener stringers 2,2 are threaded through the slider 5 from its front end 14, is smoothly introduced into the guide channel 9 along the front sloping surface 12b on the front ends of the corner ridges 12,12. In FIG. 4, P represents the meeting point where the coupling head portions 4a,4a of the opposed rows of fastener elements 4,4 begin to be interengaged; F represents the point at which a perpendicular line l from the meeting point P falls on the corner ridge 12. The front sloping surface 12b extends from the front distal end of the respective corner ridge 12 and terminates slightly short of the point F.

Figure 5:
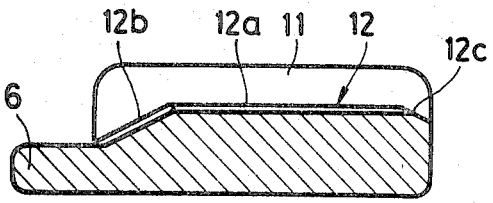
FIG. 5 is a cross-sectional view taken along section line V—V of FIG. 4.
Figure 6:
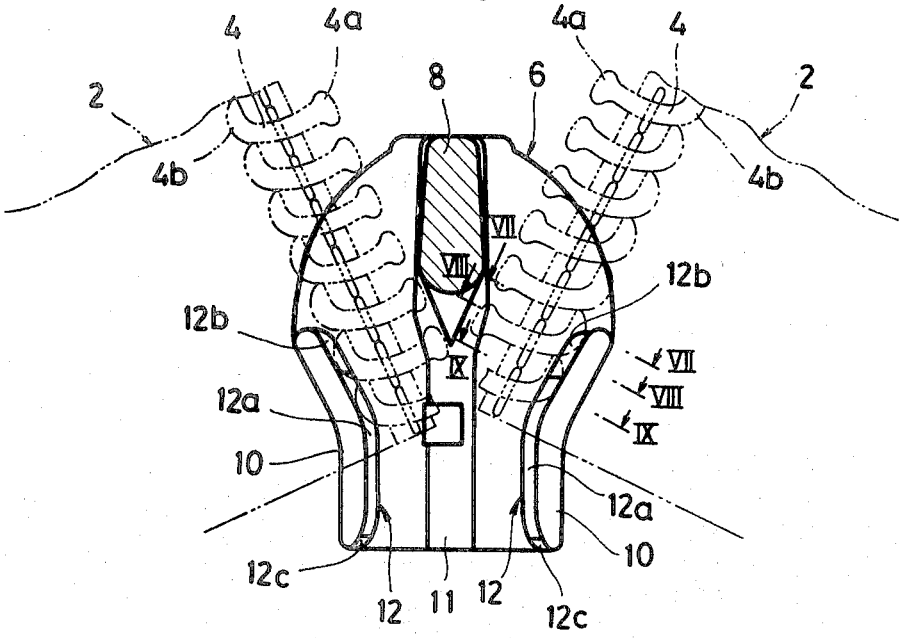
FIG. 6 is an underside view, partly in cross section, of the upper wing, showing the manner in which a pair of opposed fastener stringers is about to be threaded through the slider.
Figure 7:
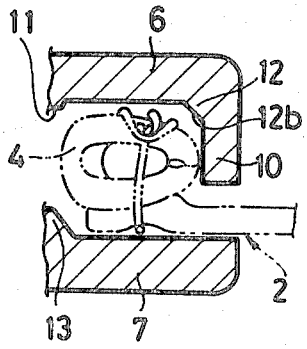
FIG. 7 is a cross-sectional view taken along section line VII—VII of FIG. 6.
Figure 8:
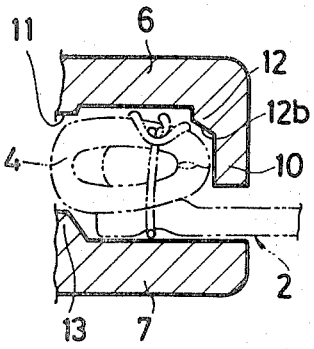
FIG. 8 is a cross-sectional view taken along section line VIII—VIII of FIG. 6.
Figure 9:
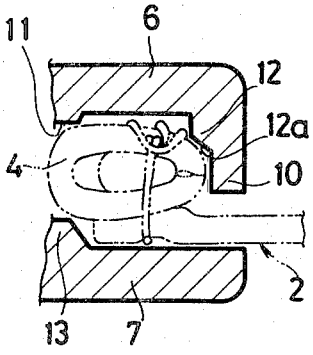
FIG. 9 is a cross-sectional view taken along section line IX—IX of FIG. 6.

Each corner ridge 12 is chamfered at the other or rear end adjacent to the rear end 16 of the slider 5 to define a rear shoping surface 12c (FIGS. 3, 4, 5) joining the pressure surface 12a. With such rear sloping surfaces 12c,12c, a leading end of the opposed rows of fastener elements 4,4, when the opposed fastener stringers 2,2, are threaded through the slider 5 from its rear end 16, can be smoothly introduced into the guide channel 9 without having been obstructed by the rear ends of the corner ridges 12,12.

FIGS. 6 to 9 illustrate the manner in which the pair of opposed fastener stringers 2,2, is threaded through the slider 5 from its front end 14. The pair of opposed fastener stringers 2,2, is disengaged or split apart and then introduced into the slider 5 from the front end 14 thereof while the slider 5 is fixed in position. At that time, the endmost fastener elements 4a,4a, which are usually laterally staggered or otherwise displaced on the tapes 3,3, are smoothly guided by the front sloping surfaces 12b,12b to their proper position on the pressure surfaces 12a,12a, since the front sloping surface 12b increases gradually in hight from the front distal end of the corner ridge 12 to the joint with the pressure surface 12a and thus makes the front mouth of the guide channel 9 flared both laterally and vertically. With continued introduction of the fastener stringers 2,2 into the slider 5, the fastener elements 4,4 following the endmost fastener elements 4a,4a are guided successively by the front sloping surface 12b,12b onto the pressure surfaces12a,12a and then begin to be interengaged smoothly and properly.

With this arrangement, partly because the front end of each corner ridge 12 is chamfered having the front sloping surface 12b contiguous to the pressure surface 12a and partly because the front mouth of the guide channel 9 is hence flared both laterally and vertically, it is possible to smoothly introduce a leading end of the opposed rows of fastener elements 4,4 into the slider 5 without having been obstructed by the front ends of the corner ridges 12,12. Thus a smooth and proper threading of the opposed fastener stringers 2,2 through the slider 5 can be achieved. Moreover, because of the pressure land 11, the corner ridges 12,12 and the pressure ridge 13, the fastener elements 4,4 having been interengaged are prevented from being tilted in the guide channel 9 of the slider 5. As a result, a reliable engagement of the opposed rows of fastener elements 4,4 is guaranteed.

The slider thus constructed not only facilitates threading of a pair of opposed fastener stringers therethrough in the manufacture of slide fasteners, but also enables a smooth and proper coupling and uncoupling of a pair of opposed fastener elements rows of the finished slide fastener as the latter is in use.

A single specific illustrative embodiment of the invention has been described. It will, of course, be appreciated however that the invention should not be limited to this specific embodiment since numerous changes and modifications may be made therein as appear obvious to one versed in the art without departing the scope of the appended claims.

What is claimed is:

1. A slider for a slide fastener having a pair of rows of fastener elements having upper and lower leg portions and coupling head portions, comprising:

(a) a pair of parallel spaced wings joined at their front end to define a generally Y-shaped guide channel for the passage of a pair of rows of fastener elements of the slide fastener, one of said wings having a base portion and a pair of flanges projecting respectively from opposite lateral edges of said base portion; and (b) a pair of raised corner ledges on the inner face of said base portion of said one wing adjacent said flanges respectively each of said corner ledges extending along an inner face of the base portion of the respective flange throughout its length and having a fastener-element pressure surface engageable with upper leg portions of one of the pair of rows of fastener elements, each fastener-element pressure surface being disposed opposite to outer end surfaces of the upper leg portions of the respective fastener element row;

(c) each said corner ledge being chamfered at its front end to define a front sloping surface which is inclined relative to said base portion and joins said pressure surface.

2. A slider according to claim 1, in which each said corner ledge is chamfered at its rear end to define a rear sloping surface joining said pressure surface.

3. A slider according to claim 1, in which said front sloping surface extends from a front distal end of the respective corner ledge and terminates short of a point on said respective corner ledge where the pair of opposed rows of fastener elements, as said slider is moved therealong, begins to be interengaged and disengaged.

4. A slider according to claim 1, in which said pressure surface is laterally inclined to fit a partial contour of the upper leg portions of the fastener elements.

5. A slider according to claim 1, in which said one wing has a fastener-element pressure land disposed centrally between said flanges and extending longitudinally of said guide channel and engageable with coupling head portions of the fastener elements, said other wing having a fastener-element pressure ridge disposed opposite to said pressure land of said one wing and locatable between adjacent longitudinal edges of a pair of stringer tapes of the slide fastener.

* * * * *